US006491863B2

(12) United States Patent
Jepson

(10) Patent No.: US 6,491,863 B2
(45) Date of Patent: Dec. 10, 2002

(54) METHOD AND APPARATUS FOR EFFICIENT UTILIZATION OF A CRYOGEN FOR INERT COVER IN METALS MELTING FURNACES

(75) Inventor: Stewart C. Jepson, Napperville, IL (US)

(73) Assignees: L'Air Liquide-Societe' Anonyme a' Directoire et Conseil de Surveillance pour l'Etude et l'Exploitation des Procedes George Claude, Paris (FR); Air Liquide America Corporation, Houston, TX (US)

( * ) Notice: Subject to any disclaimer, the term of this patent is extended or adjusted under 35 U.S.C. 154(b) by 0 days.

(21) Appl. No.: 09/735,178

(22) Filed: Dec. 12, 2000

(65) Prior Publication Data

US 2002/0070488 A1 Jun. 13, 2002

(51) Int. Cl.[7] ..... C21B 7/10
(52) U.S. Cl. ..... 266/46; 266/265; 75/709
(58) Field of Search ..... 266/216, 217, 266/44, 46, 265; 75/709

(56) References Cited

U.S. PATENT DOCUMENTS

| | | | |
|---|---|---|---|
| 3,443,806 | A | 5/1969 | Galey et al. |
| 3,484,232 | A | 12/1969 | Karinthi et al. |
| 3,619,172 | A | 11/1971 | Lutgen et al. |
| 3,640,702 | A | 2/1972 | Karinthi et al. |
| 3,664,652 | A | 5/1972 | Spire et al. |
| 3,689,048 | A | 9/1972 | Foulard et al. |
| 3,743,500 | A | 7/1973 | Foulard et al. |
| 3,868,987 | A | 3/1975 | Galey et al. |
| 4,059,424 | A | 11/1977 | Bentz |
| 4,087,899 | A | 5/1978 | Chevalier et al. |
| 4,093,553 | A | 6/1978 | Galey et al. |
| 4,178,980 | A | 12/1979 | Gilbert et al. |
| 4,179,103 | A | 12/1979 | Bentz et al. |
| 4,181,522 | A | 1/1980 | Galey et al. |
| 4,211,269 | A | 7/1980 | Bentz et al. |

(List continued on next page.)

FOREIGN PATENT DOCUMENTS

EP 0715142 B1 2/2000

OTHER PUBLICATIONS

Anderson, S. Hornby, et al., *Environmental and Steel Quality Aspects of Carbon Dioxide*, Air Liquide Canada, Bramalea, Ontario, Slater Steel Hamilton Specialty Bar Division, Hamilton, Air Liquide Canada, Hamilton, Ontario, Canada, No date.

Blostein, P., et al., *$CO^2$ Stirring In The Converter at B.H.P.—Whyalla*, $73_{rd}$ Steelmaking Conference, ISS/AIME, Detroit, Dec. 1990.

(List continued on next page.)

*Primary Examiner*—Scott Kastler
(74) *Attorney, Agent, or Firm*—Linda K. Russell

(57) ABSTRACT

Methods and apparatus for efficient utilization of a cryogen in inerting of solid and molten metals are presented. One method and apparatus of the invention includes providing a source of liquid cryogen; transporting the liquid cryogen through a conduit connected to the source of liquid cryogen to a gas/liquid separator, wherein a portion of the liquid cryogen transforms into gaseous cryogen en route; transporting a portion of the liquid cryogen through a first conduit connecting the gas/liquid separator to a cryogen supply nozzle; transporting the gaseous cryogen through a second conduit connecting the gas/liquid separator to a cryogen supply nozzle; and flowing at least a portion of liquid cryogen and at least a portion of the gaseous cryogen through the cryogen nozzle separately and near a surface of solid or molten metal. Thus liquid that transforms into gaseous cryogen en route from storage is not vented and not wasted, but used in inerting of solid or molten metals.

11 Claims, 2 Drawing Sheets

U.S. PATENT DOCUMENTS

| | | | | |
|---|---|---|---|---|
| 4,309,214 | A | 1/1982 | Foulard et al. | |
| 4,460,409 | A | 7/1984 | Devalois et al. | |
| 4,480,770 | A | 11/1984 | Goursat et al. | |
| 4,518,421 | A | 5/1985 | Foulard et al. | |
| 4,614,216 | A | 9/1986 | Savard et al. | |
| 4,657,587 | A | 4/1987 | Savard et al. | |
| 4,666,511 | A | 5/1987 | Naud | |
| 4,723,997 | A | 2/1988 | Lutgen | |
| 4,781,122 | A | 11/1988 | Foulard et al. | |
| 4,805,688 | A | 2/1989 | Foulard et al. | |
| 4,806,156 | A | 2/1989 | Anderson et al. | |
| 4,848,751 | A | 7/1989 | Lutgen et al. | |
| 4,915,362 | A | 4/1990 | Borasci et al. | |
| 4,990,183 | A | 2/1991 | Anderson et al. | |
| 5,190,577 | A | 3/1993 | Bermel et al. | |
| 5,196,072 | A | 3/1993 | Bermel et al. | |
| 5,343,491 | A | 8/1994 | Herren et al. | |
| 5,344,478 | A | 9/1994 | Zurecki et al. | |
| 5,404,929 | A | 4/1995 | Till | |
| 6,283,839 | B1 * | 9/2001 | Frederick et al. | 451/86 |
| 6,336,331 | B1 * | 1/2002 | White et al. | 62/48.2 |

OTHER PUBLICATIONS

Anderson, Sara Hornby, et al., *Cost and Quality Effectiveness of Carbon Dioxide in Steelmills*, Liquid Air Corporation, Dec. 1989 Electric Furnace Conference Proceedings, pp. 125–146.

Jensen, C.T., et al., *Atmospheric Protection of Billet Streams Using Carbon Dioxide*, Dec. 1987 Electric Furnace Proceedings.

L'Air Liquide "CONSPAL", printed in Switzerland CONSPAL–E 12000 Dec. 1979.

Air Liquide Tech Specs, *ALERT™–Molten Metal Transfer Air Liquide Emission Control Technology*, No date.

Air Liquide Tech Specs, *ALETTM–Metal Skull Removal Burners Air Liquide Emission Control Technology*, No date.

La Sorda, Terence D., *Cavity Inerting of Molten Metal Transfer Systems by Application of the Spal Process*, Air Liquide America Corporation, pp. 195–208, Steel Foundry Melting Processing, Sep. 17–19, 1996.

Armstrong No. 11–AV All Stainless Steel *Air and Gas Vent*, Bulletin No. 459, Armstrong Machine Works, No date.

Anderson, Sara Hornby, Technical Paper, *Cost and Quality Benefits of CO2 In the AOD*, Liquid Air Corporation, No date.

Anderson, Sara Hornby, et al., *Use of CO2 In The AOD, Liquid Air Corporation*, Dec. 1990 Electric Furnace Conference Proceedings.

Best, R.C. et al., *Development of Gas Swirling Method for Inerting Metals in Melting Furnaces*, American Foundrymen's Society, Inc., Castexpo '96 and 100$^{th}$ AFS Casting Congress, Dec. 1996.

Stewart Grant, *CO2 Fume Suppression—BHP/Newcastle Trials*, BOS Steel Technology Group, Dec. 1993.

* cited by examiner

METHOD AND APPARATUS FOR EFFICIENT UTILIZATION OF A CRYOGEN FOR INERT COVER IN METALS MELTING FURNACES

BACKGROUND OF THE INVENTION

1. Brief Description of the Invention

This invention generally addresses needs in the inerting of molten or solid metals, and in particular methods and apparatus to improve efficiency of use of cryogens such as argon in inerting molten or solid metals.

2. Related Art

In the metal casting industry, metals (ferrous or non-ferrous) are melted in a furnace, then poured into molds to solidify into castings. In the foundry melting operations, metals are commonly melted in electric induction furnaces. It is often advantageous to melt the metals under cover of inert gas (usually Ar or $N_2$), rather than expose the metal to atmospheric air. The inert gas cover minimizes oxidation of the metal (including its alloying components), which increases yield and alloy recovery efficiency, and also reduces formation of metallic oxides which can cause casting defects (inclusions). The inert gas cover also reduces the tendency of the molten metal to absorb gases (chiefly $O_2$ and $H_2$) from the atmosphere, which in turn reduces gas-related casting defects such as porosity. Other benefits of melt surface inerting include reduced slag formation, improved metal fluidity, increased furnace refractory life, and reduced need for de-oxidizers.

As the electric induction furnace is generally an open-top, batch melter, the inert gas ($N_2$ or Ar) is usually applied from above the furnace. Inert gas is usually applied throughout the entire melting cycle.

There are many types of furnace inerting techniques in practice today, but they can generally be classified into two major categories: Gas inerting, in which gaseous $N_2$ or Ar is (gently) blown into the top of the furnace; and liquid inerting, in which liquid $N_2$ or Ar is dripped or poured into the top of the furnace. In gas inerting, there are many different configurations of pipes and manifolds or distribution "rings" employed to blow the inert gas into the top of the furnace. These make use of varying gas pressures, velocities, discharge locations and angles of injection. Some try to minimize turbulence by creating gentle laminar flow. Some utilize a "swirling" pattern. Some techniques may employ a collar, shroud or cone-like assembly mounted on top of the furnace. However, with any gas inerting technique, it is difficult to produce and maintain a true inert (0% $O_2$) atmosphere directly at the metal surface, because hot thermal updrafts from within the hot furnace are continually pushing the incoming cold inert gas up and away from the metal surface. As the hot air and gases rise, the induced draft is continually pulling fresh cold air toward the furnace. The injected inert gas will also entrain ambient air along with it as it is injected into the furnace. Because of these effects, it is difficult, if not impossible, for gas inerting techniques to provide a true inert (0% $O_2$) atmosphere directly at the surface of the metal.

With liquid inerting (such as taught in U.S. Pat. No. 4,806,156), the liquid cryogen (typically $N_2$ or Ar) has higher density than its gas phase and air, and is much less likely to be pushed up and away from the melt surface by the thermal updrafts. The liquid drops or stream are much better able to fall all the way down to the actual metal surface (hot solid metal or molten metal). After contacting the metal surface, within a short time, the liquid vaporizes into a gas. (The appearance is similar to drops of water "dancing" on a hot pancake griddle). As the $N_2$ or Ar boils from liquid to gas, it expands volumetrically by a factor of 600–800 times as it rises. This expansion pushes ambient air away from the surface of the metal. In this manner, liquid inerting provides a more effective, true inert (0% $O_2$) atmosphere directly at the metal surface, as compared to gas inerting. With liquid inerting, inert gas usage efficiency is generally increased; i.e. it requires a lower quantity of inert gas to achieve the same performance as gas inerting.

One drawback of liquid inerting is the difficulty of efficiently delivering the liquid $N_2$ or Ar to the furnace interior in a liquid state. The liquefied gas (preferably $N_2$ or Ar) is extremely cold (approximately −184° C.). In the storage tank and distribution piping, the liquid inert gas is continually absorbing heat from the surroundings. This ambient heat pickup manifests itself by boiling some of the liquid to vapor inside the storage tank and distribution piping. The tank and piping is insulated as much as practically possible (typically 7 to 11 cm foam, or vacuum-jacket). The tank-to-furnace piping distance is kept as short as possible (in practice, usually about 15 to 50 m). In spite of these efforts, there is always some amount of liquid that will unavoidably boil to vapor, due to this ambient heat pickup. In addition, some liquid will always "flash" boil to vapor by virtue of pressure reduction alone. The liquid is stored at elevated pressure (typically 2 to 7 bar) in the storage tank, in equilibrium with its vapor phase. Elevated pressure is necessary to provide the driving force to "push" the liquid out of the tank, through the distribution piping. As a matter of practicality, there is usually a vertical elevation rise in the piping which needs to be overcome, and there is some pressure drop through the final liquid discharge device (diffuser). So, as the liquid $N_2$ or Ar travels through the piping, pressure decreases (eventually to atmospheric pressure at the discharge point), and more and more of the liquid boils to vapor. Due to these combined effects (ambient heat pickup and pressure drop), by the time the liquid $N_2$ or Ar reaches the discharge point at the furnace, it is estimated that roughly 0.5% to as much as 30% has boiled to vapor, depending on the parameters of the particular system.

Due to volumetric expansion, the vapor (gas phase) occupies much more space than the liquid. In the piping, this expanding gas restricts, or "chokes" the flow of liquid by occupying a greater and greater portion of the volume available in the pipe. Hence the $N_2$ or Ar in the pipe can be mostly liquid by mass, but mostly vapor by volume.

The result is that "sputtering" or "surging" flow is observed at the discharge end of the pipe. "Sputtering" flow is a combination of gas and "spraying" liquid, often unsteady in appearance with time, with respect to the observed amount of liquid flow. "Surging" flow is a more extreme condition, in that there is observed alternating time periods of "gas only" discharge, and "gas plus liquid sputtering" discharge. Sputtering and surging flow is caused by the generated vapor "bubbles" working their way out of the system piping. The greater the percentage of vaporization, the more extreme the observed sputtering and/or surging will be.

Sputtering or surging flow will reduce the furnace inerting effectiveness, for liquid inerting processes. Compared to a compact, well organized and steady (small) liquid stream, or compared to relatively large droplets, a spray or mist of fine liquid droplets will have much greater surface area, and will therefore absorb heat from the furnace environment much more quickly, vaporizing more quickly, and therefore be less likely to fall all the way down to the metal surface in the liquid state, therefore providing a less effective inert atmosphere at the metal surface. The most effective liquid inerting is provided by a compact, well-organized and steady liquid stream, or by a steady succession of relatively large liquid droplets (minimum liquid surface area).

It is common to use a diffuser, or tight mesh screen (typically sintered metal filter, approximately 40 micron size), at the discharge of the liquid pipe, in order to minimize sputtering flow. The diffuser "catches" the sputtering spray of gas and small liquid drops, reducing the liquid velocity and re-organizing the drops into larger liquid droplets or a steady liquid stream, which generally drips out the bottom portion of the diffuser, while the gas generally seeps out the top. This diffuser is surrounded by an outer shroud, or cone, which protects the diffuser from molten metal splash, and can also help to organize the emerging liquid droplets into a more focused, single stream. The diffuser/cone assembly, then, helps to provide a more compact, well-organized and steady liquid stream or succession of larger droplets, to improve furnace inerting effectiveness (i.e. reduces the percentage of emerging liquid droplets that evaporate in the furnace).

However, even by using a diffuser/cone assembly, and after minimizing the piping distance, insulating the pipe and tank as much as possible, and reducing the tank pressure to as low a level as possible, what emerges from the diffuser is still a combination of liquid and gas. Vaporization of some of the liquid to gas is unavoidable. In many cases, sputtering flow, or even surging flow is still observed. The greater the percentage of vapor mixed with gas, the more extreme the sputtering and/or surging will be, and the greater the reduction in furnace inerting effectiveness. As the ambient heat input to the system (tank plus piping) is relatively constant (function of total surface area and temperature difference), the absolute amount of liquid boiling to vapor will be essentially fixed, for a given system. So, as liquid flowrate is increased, the percentage of vapor will be reduced. In practice, then, in order to achieve a stable and consistent liquid flow, as opposed to surging, furnace operators will increase the total $N_2$ or Ar (liquid) flow higher and higher until surging is eliminated (i.e. flood the system with liquid). In many cases, due to high levels of vaporization (caused by high ambient heat pickup or large pressure drop), the total $N_2$ or Ar flowrate is higher than what it really needs to be, to provide effective and consistent inerting for a given furnace. This increases operating cost, and can create potential for explosions, by having too large a quantity of liquid pooling on top of the molten metal. Hence, in many cases, if vaporization could be reduced, then total flowrates could be reduced, and operating cost could be reduced while improving operator safety.

One way to reduce surging and to provide a more consistent, stable liquid flow is to remove the generated gas bubbles from the piping, prior to the diffuser. This is described in U.S. Pat. No. 4,848,751 (special lance). This method utilizes a double-wall (concentric) pipe as the last section of liquid Ar or $N_2$ piping before the diffuser. A small hole is located in both the inner and outer pipes, pointing vertically upward, with the inner hole at the discharge end and the outer hole at the inlet end. Vapor generated inside the piping is allowed to escape through the inner hole. This cold "sacrificial" vapor travels through the annular region between the inner and outer pipe, counter to the flow of liquid (and gas) in the inner pipe, and escapes to atmosphere through the hole in the outer pipe. Thus, some of the vapor is allowed to escape the piping system before the gas/liquid mixture discharges through the diffuser, and the escaping vapor is utilized to help cool (insulate from further heat pickup) the last section of pipe (generally positioned over the hot furnace) to reduce further evaporation. However, the chemical value of the escaping vapor is wasted, in that it is vented to atmosphere, rather than being sent into the furnace. Also, it is not clear that the size and location of the holes is optimum for each individual installation. Also, since gas bubbles generated in the piping generally will rise to the highest point in the piping system, it is not clear that all of the vapor will consistently and effectively be purged through these holes in the concentric pipe lance, since it is located at the discharge end of the piping (at the furnace), which is usually the lowest point in the system piping.

Another technique for removing vapor bubbles from the piping is to utilize a gas-liquid phase separator device in the piping. These are sometimes referred to as gas vents, or "keep-full" devices. These are commercially available devices. One or more are mounted, typically, in the highest point in the piping system, generally close to the discharge end. The gas vent device typically includes an internal float and valve mechanism, inside a small chamber. Liquid accumulates in the bottom of the chamber, raising the float by buoyancy force, which closes the gas vent valve on top of the chamber. As gas accumulates in the piping, generally rising to the highest point, it will accumulate in the "dome" or upper portion of the chamber, displacing liquid in the chamber, until eventually the float drops low enough to open the top gas vent valve. This allows gas to vent out the top, until enough liquid re-fills the bottom of the chamber to push the float up, which closes the vent valve. The cycle then repeats, indefinitely. This simple mechanical device helps to continually and automatically vent gas from the system piping, which increases the percentage of liquid, which helps to reduce surging flow, and allows the operator to reduce the total liquid flow required to maintain stable, consistent liquid flow. However, the purged as is vented to atmosphere, and again, its chemical (inerting) value is wasted. Also, while the gas vent valve periodically opens to vent gas to atmosphere, system pressure is reduced. This can reduce the driving force for pushing liquid through the piping system, causing the operator to increase tank pressure, which results in additional flash vaporization. Or, the periodic venting to atmosphere with subsequent pressure reduction can cause additional liquid to vaporize, due to the premature reduction in pressure.

Finally, in many liquid inerting systems, a small metering orifice is placed just upstream from the diffuser. This is sized to allow a constant "correct" amount of flow to the diffuser downstream. However, this can compound the severity of observed surging, since all liquid and gas must pass through this small orifice—it can take longer for gas bubbles to work their way through this orifice. Also, with time, as system insulation value deteriorates, and heat input to the system increases, the percent vaporization increases, and the metering orifice may in fact become "too small", and surging flow is exhibited where at one time it was steady. The operator then is forced to increase the size of the metering orifice (open up the metering orifice valve).

It would be an advance in the art if more efficient methods and apparatus were developed to overcome some or all of the above problems.

SUMMARY OF THE INVENTION

In accordance with the present invention, methods and apparatus are presented which overcome some or all of the mentioned disadvantages of previous systems.

One aspect of the invention is an apparatus for efficient utilization of a cryogen in inerting of molten or solid metals, the apparatus comprising:

a) a source of liquid cryogen;

b) a conduit connected to said source of liquid cryogen for transporting said liquid cryogen to a gas/liquid separator (also denoted as a "gas vent device" herein);

c) a first conduit connecting the gas/liquid separator to a cryogen inerting nozzle and adapted to supply liquid cryogen to the cryogen inerting nozzle, the cryogen inerting nozzle positioned over molten or solid metal in a container; and d) a second conduit connecting the gas/liquid separator to the container at a position over the molten or solid metal, the second conduit adapted to supply gaseous cryogen to the molten or solid metal.

Preferably, the second conduit connects the gas/liquid separator to an outer section of the cryogen inerting nozzle, as further described herein. Preferred apparatus also comprise insulation for the first and second conduits to maintain temperature as low as possible.

A second aspect of the invention is a method for efficient utilization of a cryogen in inerting of solid or molten metals, the method comprising:

a) providing a source of liquid cryogen;

b) transporting said liquid cryogen through a conduit connected to the source of liquid cryogen to a gas/liquid separator (also denoted a gas vent device herein), wherein a portion of the liquid cryogen transforms into gaseous cryogen;

c) transporting a portion of the liquid cryogen through a first conduit connecting the gas/liquid separator to a cryogen supply nozzle positioned over solid or molten metal in a container;

d) transporting at least a portion of said gaseous cryogen through a second conduit connecting the gas/liquid separator to the container, and preferably to the cryogen inerting nozzle; and e) flowing the portion of liquid cryogen through the cryogen inerting nozzle near a surface of solid or molten metal in the container, and flowing at least a portion of the gaseous cryogen near the same surface of solid or molten metal, preferably through the cryogen inerting nozzle.

Liquid inerting effectiveness can be decreased due to vaporization of liquid in the system piping, as described. Removal of this gas before reaching the discharge diffuser can improve inerting effectiveness. The new method utilizes this vented gas in the furnace to assist with inerting, rather than venting the gas to atmosphere. The known diffuser/cone assembly is replaced with a novel cryogen supply nozzle, preferably shaped like a cone, which incorporates a second connection for this gas. The gas vented from the piping (via a gas vent device) is fed to this novel cryogen supply nozzle. Preferably, a pressure regulator or similar device can be used in the gas vent line to maintain the desired back pressure on the gas vent device and system piping, while venting gas from the piping system.

DESCRIPTION OF PREFERRED EMBODIMENTS

Figure 1:
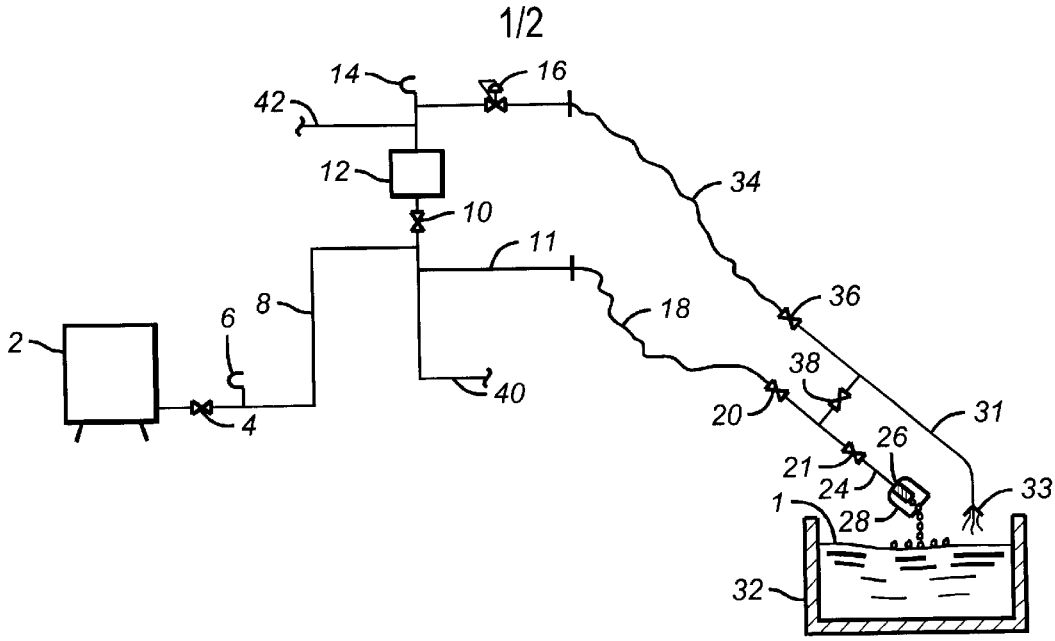
FIG. 1 is a schematic process flow diagram of methods and apparatus of the invention in a first embodiment.

Referring now to the drawing figures, FIG. 1 illustrates schematically one embodiment of the process and apparatus in accordance with the present invention for inerting solid or molten metals. FIG. 1 illustrates a bulk liquid cryogen storage tank, where the cryogen is preferably $N_2$, Ar, $CO_2$. The liquid cryogen is preferably in a saturated liquid state, where the saturated liquid is in equilibrium with vapor phase at an elevated pressure. Liquid bulk storage tank 2 feeds liquid cryogen via a shutoff valve 4 through distribution piping 8, where distribution pipe 8 preferably includes a safety pressure relief valve 6 to relieve in case of overpressure. Distribution piping 8 is generally outdoors, originates at ground level, and generally and preferably is routed to an elevated header inside of a melt shop or other building, and then has individual "drop legs" as explained herein. The drop legs are typically flex hoses which are routed to each furnace or pair of furnaces. The distribution piping can have one or more drop legs from each header.

The system in FIG. 1 preferably includes a shut-off valve 10 which connects the distribution piping to a gas liquid separation device 12, which preferably includes a chamber with an internal float connected to an internal upper gas vent valve. A safety pressure relief valve 14 can also be included as shown. Liquid cryogen flows through piping 11 through a flex hose 18, liquid shut-off valve 20, a metering orifice 21, and piping connection 24, and eventually exits through a diffuser 26 which is located inside cryogen inerting nozzle 28. Preferably, the piping connection 24 is a double wall lance pipe as described in U.S. Pat. No. 4,848,751, incorporated herein by reference. Gas liquid separation device 12 could be also a simple pipe "tee," (preferably larger than piping 11 in diameter), installed at or near the highest point, with a gas vent pointing vertically.

Following the gas flow through the system illustrated in FIG. 1, a pressure regulator or in-line pressure relief valve 16 is preferably provided. Pressure regulator 16 maintains the desired back pressure to the gas liquid separation device 12, and to distribution piping 8, rather than allowing the gas vent 12 to discharge to atmosphere, which can reduce system pressure. A flex hose 34 connects with a gas adjusting valve 36, piping connection 31, and nozzle 33 for allowing gaseous cryogen to be routed toward the molten or solid metal 1, being held in container 32. Preferably, an adjusting valve or orifice can be provided as indicated at 38, to allow additional gas purged from the liquid line 18 and 24 into the gas line 31. Valve 38 preferably includes a check valve (one-way valve) to allow gas to flow into the gas system, but not to allow gas to flow back into the liquid piping system 18 and 24. Valve connection 38 may also include a pressure regulator or in-line relief valve, to maintain pressure in liquid lines 11, 18, and 24.

Also indicated in FIG. 1 is a connection 40 for routing liquid cryogen to another furnace, and a connection 42 for routing gaseous cryogen to another container. Distribution pipe 8 can be a header pipe to distribute cryogen to multiple furnace containers 32. Cryogen can be supplied to each furnace via its own nozzles 28, 31 and 33, and diffuser 26. Hence, items 10–38 can be replicated as needed for multiple furnaces.

Figure 2:
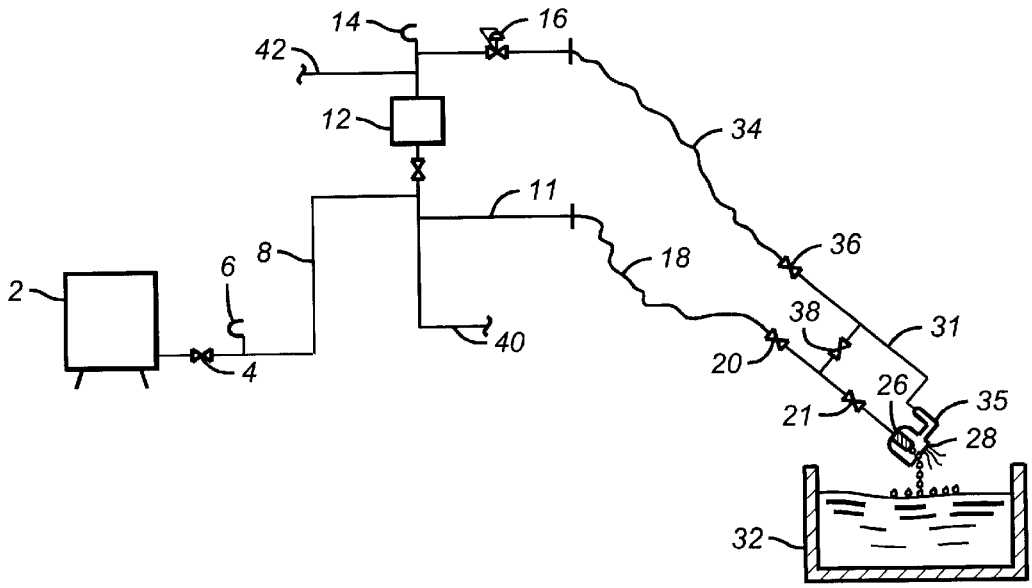
FIG. 2 is a schematic process flow diagram of a second embodiment of process and apparatus in accordance with the present invention.
Figure 3:
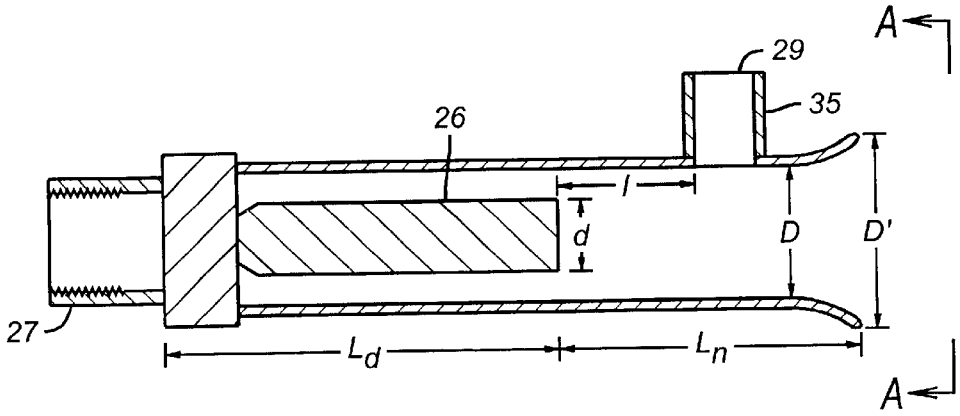
FIG. 3 is a cross-section, side elevation view of a cryogen inerting nozzle in accordance with one embodiment of the invention.

Referring now to FIG. 2, illustrated is another embodiment of a method and apparatus suitable for practicing the invention. The system illustrated in FIG. 2 differs only from that illustrated in FIG. 1 in the construction of cryogen inerting nozzle 28, which has also a gas providing connection 35 taking feed from gaseous cryogen conduit 31. This version of the nozzle 28 and connection 35 is better viewed with reference to FIGS. 3 and 4. FIG. 3 is a side elevation cross-sectional view of the nozzle 28 and connection 35, illustrating certain dimensions. Liquid cryogen enters at 27, while gaseous cryogen enters at 29. The internal diameter of liquid cryogen nozzle 28, denoted as D, preferably ranges from about 2 cm up to about 10 cm, more preferably ranging from about 2 cm to about 5 cm, depending on the amount of cryogen desired. The exit end of nozzle 28 has a larger diameter D', than the internal diameter D of nozzle 28. This slight flaring of the exit of the nozzle provides certain advantages, for example, the liquid may have a better drip characteristic, and the gaseous cryogen may spread to a wider area of the molten or solid metal in container 32. The ratio of a diameter D divided by D' typically and preferably ranges from about 0.5 to 1, up to 1 to 1. FIG. 3 also illustrates diameter d of diffuser 26, with diameter d ranging from about 5% up to about 90% of the diameter D. It should be recognized by those skilled in the art that diffuser 26 need not be cylindrical or round in construction but could be rectangular or any other shape including a T-shaped element. A distance I from terminal tip of diffuser 26 to the entrance of connection 35 typically ranges from about 0 to about 3 diameters equal to d, the diameter of diffuser 26. Lengths denoted as $L_d$ and $L_n$ are also illustrated in FIG. 3. The dimension $L_d$ corresponds to the axial length of diffuser 26, while the length denoted $L_n$ denotes the distance from the end of diffuser 26 to the exit of nozzle 28. Preferably, the distance $L_d$ ranges from about 0.5 to about 3 times the diameter D, while the length dimension $L_n$ is preferably 0.1 to 1.5 times the length dimension $L_d$.

Figure 4:
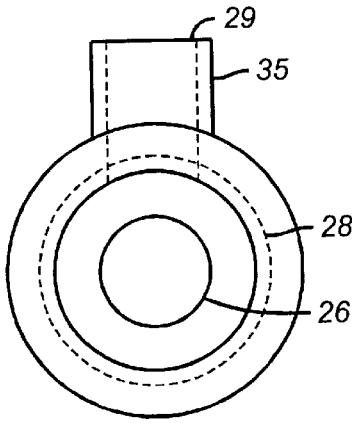
FIG. 4 is a view of the cryogen inerting nozzle of FIG. 3 viewed from one end denoted A—A in FIG. 3.
Figure 4A:
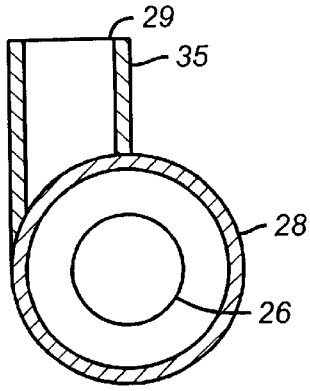
FIG. 4A illustrates an end elevation sectional view of an alternate embodiment of the device illustrated in FIG. 3.

FIG. 4 illustrates the end view along the view A—A denoted in FIG. 3, illustrating that diffuser 26 is substantially centered within a cylindrical cryogen inerting nozzle 28. It should be noted that this is preferred only and that diffuser 26 could be located in a non-central location in reference to the axial center line of nozzle 28. Also as illustrated in FIG. 4, gaseous cryogen connection 35 is indicated as being connected non-tangentially to nozzle 28, however, connection 35 could be tangentially connected as indicated in FIG. 4A. FIG. 4A shows an alternate embodiment where gas connection 35 is tangentially connected to cryogen delivery nozzle 28. The embodiment of FIG. 4A would tend to give a swirling motion to the gaseous cryogen as it exits nozzle 28. It can also be envisioned to install swirling elements on an internal surface of nozzle 28 to create more swirl for gaseous cryogen. With either FIG. 4 OR 4A, it can also be envisioned to utilize a substantially larger diameter D of the nozzle 28, to provide broader gas coverage in the furnace 32.

Figure 5:
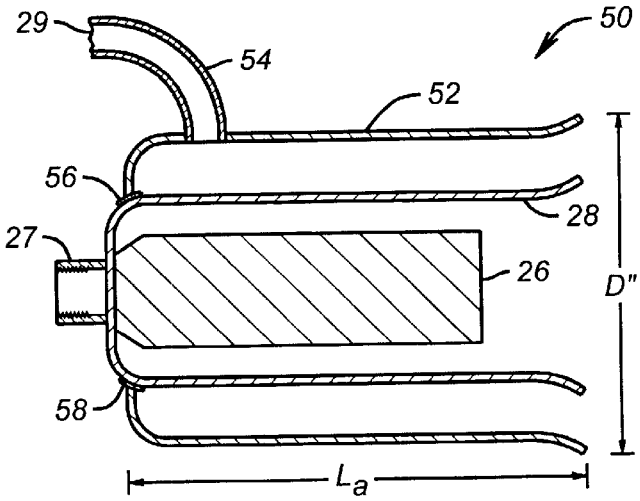
FIG. 5 is a cross-sectional, side elevation view of an alternate cryogen inerting nozzle in accordance with the present invention.

FIG. 5 illustrates an alternate embodiment 50 of a nozzle useful for delivering liquid and gaseous cryogen for the purposes of the invention. A nozzle 28 as in previous embodiments is fitted with an annular section 52 basically surrounding the nozzle 28, and creating an annular space for gaseous cryogen to enter through a piping connection 54. Thus, only liquid would exit through the nozzle 28 via diffuser 26, whereas, gaseous cryogen would exit the annular region formed between nozzle 28 and annular section 52. Annular section 52 may be connected to nozzle 28 such as by welds 56 and 58. Piping connection 54 may be non-tangentially connected to annular connection 52 or it may be tangentially connected to provide a swirling flow of cryogen.

EXAMPLE

At initial startup of liquid cryogen flow (such as after a weekend shutdown or the like), valves 4, 10, 20, and 21 are fully opened. Since the piping (8, 11, etc.) is initially warm (room temperature), liquid cryogen will be vaporized as it travels through the pipe. Typically, several minutes are required in order to cool the piping system to cryogenic temperatures, and attain steady state flow conditions. Hence valve 21 is kept full open, initially, while 100% gas discharges through the diffuser 26 and nozzle 28. As liquid begins to appear out the nozzle 28, this is an indication that the piping is beginning to cool, and valve 21 is gradually closed in order to maintain the desired (small) liquid flow rate. At steady state conditions, when the piping system has fully cooled to its ultimate steady state temperature, ideally valve 21 will be fully closed, and the desired liquid flowrate is maintained through the fixed metering orifice hole in valve 21. Valve 36 (gas vent line) is opened at some point during this cool down process (either at beginning or after some time).

Once the system has reached steady state with respect to piping cool down, then valve 36 and/or regulator 16 can be adjusted, along with valve 21, in order to provide optimum performance (consistent, stable liquid flow, without surging or sputtering, at minimum flowrate). Without the gas vent line 34 and/or gas vent device 12, in many cases, total cryogen flow is increased unnecessarily (by opening valve 21) in order to maintain consistent, stable liquid flow without surging. By opening and adjusting the (optional) one-way valve 38, further fine-tuning can be accomplished, by creating an additional "gas escape path" for vapor generated in the piping in close proximity to the hot furnace, i.e. pipe 24.

In one experimental setup, at steady state flow conditions, when valve 36 (gas vent valve) was closed, it was observed that valve 21 had to be opened wider in order to maintain stable, consistent liquid flow without surging. When valve 36 was opened, creating an escape path for gas generated in the piping, then stable liquid flow (no surging) could be maintained with valve 21 in a more closed position. This suggests that by segregating the liquid and gas flow in this manner, the required overall flowrate of cryogen for a given system potentially can be reduced. Or, at minimum, the consistency and quality of liquid cryogen delivered to the furnace is improved, thereby increasing inerting effectiveness. And with the novel technique of utilizing the vented gas in the furnace (via nozzle 33 or connection 35), as opposed to wasting it by venting to atmosphere, efficient utilization of cryogen is further improved.

Recognizing that in the absence of a gas vent line 34 or a gas vent device 12, a certain percentage of the cryogen discharging from the diffuser 26 and nozzle 28 will always be gas, the novelty is that, first, the gas and liquid flow is segregated, in order to provide greater uniformity, stability and consistency of liquid flow (with potentially reduced overall flow requirement), and second, the vented gas is now routed back to the furnace in order to utilize its inerting value, rather than wasting it by venting to atmosphere, which further contributes to increased efficiency of cryogen utilization.

This apparatus and method, therefore, can provide greater economy (reduced overall cryogen consumption) with improved inerting effectiveness (through more consistent, stable liquid flow) while improving operator safety (minimized liquid flowrate reduces risk of explosion from liquid "pooling" on molten metal surface).

Preferred processes for practicing the present invention have been described. It will be understood and readily apparent to the artisan that many changes and modifications may be made to the above-described embodiments without departing from the spirit and the scope of the present invention. The foregoing is illustrative only and that other embodiments of the integrated process can be employed without departing from the true scope of the invention defined in the following claims

What is claimed is:

1. An apparatus for efficient utilization of a cryogen in inerting of molten or solid metals, the apparatus comprising:

a) a source of liquid cryogen;

b) a conduit connected to said source of liquid cryogen for transporting said liquid cryogen to a gas/liquid separator;

c) a first conduit connecting the gas/liquid separator to a cryogen inerting nozzle and adapted to supply at least a portion of said liquid cryogen to said cryogen inerting nozzle, the cryogen inerting nozzle positioned over molten or solid metal in a container; and d) a second conduit connecting the gas/liquid separator to the container at a position over the molten or solid metal, the second conduit adapted to supply at least a portion of gaseous cryogen separated from said liquid cryogen in said gas/liquid separator to the molten or solid metal , the second conduit connecting the gas/liquid separator to an outer section of the cryogen inerting nozzle.

2. An apparatus for efficient utilization of a cryogen in inerting of molten or solid metals, the apparatus comprising:

a) a source of liquid cryogen;

b) a conduit connected to said source of liquid cryogen for transporting said liquid cryogen to a gas/liquid separator;

c) a first conduit connecting the gas/liquid separator to a cryogen inerting nozzle and adapted to supply at least a portion of said liquid cryogen to said cryogen inerting nozzle, the cryogen inerting nozzle positioned over molten or solid metal in a container, the cryogen inerting nozzle comprising a liquid discharge component and a side connection connected at one end to an opening to the liquid discharge component and a second end connected to the second conduit, the side connection adapted to deliver gaseous cryogen from the gas/liquid separator; and d) a second conduit connecting the gas/liquid separator to the container at a position over the molten or solid metal, the second conduit adapted to supply at least a portion of gaseous cryogen separated from said liquid cryogen in said gas/liquid separator to the molten or solid metal.

3. An apparatus in accordance with claim 2, wherein the liquid discharge component comprises a substantially cylindrical element, having a wall, one end of said substantially cylindrical element connected to said first conduit, and said side connection connected to an external side of said wall of said substantially cylindrical element in a fashion to allow gaseous cryogen to traverse through said wall into an interior of said substantially cylindrical element.

4. An apparatus in accordance with claim 3, wherein said substantially cylindrical component has a diffuser removably connected to an internal surface of said wall and adapted to deliver liquid cryogen therethrough.

5. An apparatus for efficient utilization of a cryogen in inerting of molten or solid metals, the apparatus comprising:

a) a source of liquid cryogen;

b) a conduit connected to said source of liquid cryogen for transporting said liquid cryogen to a gas/liquid separator;

c) a first conduit connecting the gas/liquid separator to a cryogen inerting nozzle and adapted to supply at least a portion of said liquid cryogen to said cryogen inerting nozzle, the cryogen inerting nozzle positioned over molten or solid metal in a container, the cryogen inerting nozzle comprising substantially cylindrical liquid discharge component, and a substantially cylindrical gaseous discharge connection attached to the liquid discharge component, the liquid discharge component and gaseous discharge connection form an annulus therebetween for delivery of gaseous cryogen; and d) a second conduit connecting the gas/liquid separator to the container at a position over the molten or solid metal, the second conduit adapted to supply at least a portion of gaseous cryogen separated from said liquid cryogen in said gas/liquid separator to the molten or solid metal.

6. An apparatus in accordance with claim 5, wherein a diameter D' of said gaseous discharge connection is 1.0D to 2.0D, where D is a diameter of said liquid discharge component.

7. An apparatus in accordance with claim 5 wherein a length $L_a$ ranges from 0.3 to 2.0 times the sum of $L_d$ and $L_n$, where $L_a$ is a length of said gaseous discharge connection, $L_d$ is a length of a diffuser, and $L_n$ is a distance from an end of said diffuser to an end of said cryogen inerting nozzle.

8. An apparatus in accordance with claim 2, wherein a length $L_d$ ranges from about 0.5 to about three times the diameter D, while the length dimension $L_n$ is typically 0.1 to 1.5 times the length dimension $L_d$.

9. An apparatus in accordance with claim 2, wherein the side connection connects tangentially to said liquid discharge component.

10. A method for efficient utilization of a cryogen in inerting of solid or molten metals, the method comprising:

a) providing a source of liquid cryogen;

b) transporting said liquid cryogen through a conduit connected to the source of liquid cryogen to a gas/liquid separator wherein a portion of the liquid cryogen transforms into gaseous cryogen;

c) transporting a portion of the liquid cryogen through a first conduit connecting the gas/liquid separator to a cryogen supply nozzle positioned over solid or molten metal in a container;

d) transporting at least a portion of said gaseous cryogen through a second conduit connecting the gas/liquid separator to the container;

e) flowing the portion of liquid cryogen through the cryogen inerting nozzle near a surface of solid or molten metal in the container, and flowing at least a portion of the gaseous cryogen near the same surface of solid or molten metal, wherein the gaseous cryogen is delivered tangentially to the cryogen inerting nozzle.

11. A method for efficient utilization of a cryogen in inerting of solid or molten metals, the method comprising:

a) providing a source of liquid cryogen;

b) transporting said liquid cryogen through a conduit connected to the source of liquid cryogen to a gas/liquid separator wherein a portion of the liquid cryogen transforms into gaseous cryogen;

c) transporting a portion of the liquid cryogen through a first conduit connecting the gas/liquid separator to a cryogen supply nozzle positioned over solid or molten metal in a container;

d) transporting at least a portion of said gaseous cryogen through a second conduit connecting the gas/liquid separator to the container;

e) flowing the portion of liquid cryogen through the cryogen inerting nozzle near a surface of solid or molten metal in the container, and flowing at least a portion of the gaseous cryogen near the same surface of solid or molten metal, wherein the gaseous cryogen is delivered to an annular region in the cryogen inerting nozzle.

* * * * *